US008448359B2

(12) United States Patent
Adams

(10) Patent No.: US 8,448,359 B2
(45) Date of Patent: May 28, 2013

(54) CLOTHING IRON HOLDER WITH WATER RESERVOIR

(75) Inventor: Sky A. Adams, Hephzibah, GA (US)

(73) Assignee: Sky A. Adams, Hephzibah, GA (US)

( * ) Notice: Subject to any disclaimer, the term of this patent is extended or adjusted under 35 U.S.C. 154(b) by 119 days.

(21) Appl. No.: 13/267,680

(22) Filed: Oct. 6, 2011

(65) Prior Publication Data

US 2012/0017475 A1 Jan. 26, 2012

Related U.S. Application Data

(63) Continuation-in-part of application No. 12/448,818, filed as application No. PCT/US2007/025827 on Dec. 19, 2007, now Pat. No. 8,051,589.

(60) Provisional application No. 60/897,061, filed on Jan. 24, 2007.

(51) Int. Cl.
*D06F 79/02* (2006.01)
*D06F 75/14* (2006.01)

(52) U.S. Cl.
USPC ..... 38/96; 219/259

(58) Field of Classification Search
USPC ..... 38/77.3, 77.4, 77.6, 79, 96, 88; 219/259
See application file for complete search history.

(56) References Cited

U.S. PATENT DOCUMENTS

| | | | | | |
|---|---|---|---|---|---|
| 2,445,506 | A | * | 7/1948 | Baker | 38/77.3 |
| 2,620,576 | A | * | 12/1952 | Stevenson et al. | 38/77.3 |
| 5,074,066 | A | | 12/1991 | Sakano et al. | |
| 5,108,056 | A | | 4/1992 | McBounds | |
| 5,117,092 | A | | 5/1992 | Shimizu et al. | |
| 5,315,773 | A | * | 5/1994 | Iwami et al. | 38/77.6 |
| 5,414,945 | A | | 5/1995 | Freeman et al. | |
| 5,909,862 | A | | 6/1999 | Ratliff et al. | |
| 6,021,591 | A | * | 2/2000 | Basile | 38/77.6 |
| 6,116,550 | A | | 9/2000 | Forbes | |
| 6,212,332 | B1 | | 4/2001 | Sham et al. | |
| 6,550,164 | B2 | | 4/2003 | Rosa | |
| 6,622,404 | B2 | | 9/2003 | Valiyambath | |
| 7,140,580 | B1 | | 11/2006 | Hays | |

FOREIGN PATENT DOCUMENTS

WO WO 01/64992 9/2001

* cited by examiner

*Primary Examiner* — Ismael Izaguirre
(74) *Attorney, Agent, or Firm* — Litman Law Offices, Ltd.

(57) ABSTRACT

The clothing iron holder with water reservoir is a protective accessory for use with a clothing iron or the like. The holder includes a water reservoir having a front portion, a central portion, and a rear portion, and is sized and shaped to receive the clothing iron. The front portion has an opening formed therethrough for releasably covering and connecting to a water fill opening of the clothing iron such that water exiting the water fill opening is received within the water reservoir. Thus, if the iron accidentally falls or is tipped over, the water will spill into, and be collected within, the water reservoir.

20 Claims, 4 Drawing Sheets

CLOTHING IRON HOLDER WITH WATER RESERVOIR

CROSS-REFERENCE TO RELATED APPLICATION

This application is a continuation-in-part of U.S. patent application Ser. No. 12/448,818, filed on Jul. 8, 2009, now U.S. Pat. No. 8,051,589 which is the U.S. national phase of International Patent Application Serial Number PCT/US2007/025827, filed Dec. 19, 2007, which claimed priority to U.S. Provisional Patent Application Ser. No. 60/897,061, filed Jan. 24, 2007.

BACKGROUND OF THE INVENTION

1. Field of the Invention

The present invention relates to protective holders and supports for a steam-type clothing iron. Particularly, the clothing iron holder includes protective, heat-resistant padding for the clothing iron, and further includes a water reservoir for collecting water spilled from the water fill opening of the clothing iron.

2. Description of the Related Art

Clothing irons are typically heavy pieces of equipment that operate at relatively high temperatures. When not ironing clothing, users typically rest the clothing iron on its rear face, such that the heated contact plate is positioned substantially orthogonal to the clothing or ironing surface. This position, however, is not particularly stable, and the iron may be easily tipped over or dropped. The weight of the iron may cause injury to the user, or may damage nearby furniture or the floor surface. Further, the iron operates at relatively high temperatures, and the user could be easily burned, or nearby furniture or carpeting, for example, could burn or catch on fire. Additionally, steam irons typically include an open water filling port adjacent the handle portion, and upon falling, the heated water contained therein will spill out.

It would be desirable to provide a holder for a clothing iron that not only allows the iron to be stably positioned and stored, but also offers protection from injury due to the iron's weight, and from the high temperature of the iron. It would be further desirable to provide a holder that also prevents water spillage during an accidental fall. It would be additionally desirable if spilled water could be collected within the holder for later re-usage.

Thus, a clothing iron holder with a water reservoir solving the aforementioned problems is desired.

SUMMARY OF THE INVENTION

The clothing iron holder with water reservoir is a protective accessory for use with a clothing iron or the like. The holder includes a water reservoir having a front portion, a central portion and a rear portion, and is sized and shaped to receive the clothing iron. The front portion has an opening formed therethrough for releasably covering and connecting to a water fill opening of the clothing iron such that water exiting the water fill opening is received within the water reservoir. Thus, if the iron accidentally falls or is tipped over, the water will spill into, and be collected within, the water reservoir.

The front portion of the water reservoir is in fluid communication with the central portion, and the central portion is in fluid communication with the rear portion. The rear portion includes a closed upper end for retaining the water therein. Further, when received within the holder, a lower face of the clothing iron is supported by an upper surface of the central portion, and the upper surface preferably has a heat-resistant, upper padded layer formed thereon.

When held within the holder, preferably a front face of the clothing iron securely contacts a rear surface of the front portion, and a rear face of the clothing iron securely contacts a front surface of the rear portion. A clamp or other suitable means for releasable securement may be provided for retaining the clothing iron within the holder.

The heat-resistant, upper padded layer may have a plurality of conduits formed therethrough, allowing steam generated by the clothing iron to escape through the conduits and be collected within the water reservoir, where the steam will condense into liquid water. Each conduit is covered and sealed by a one-way valve seal, allowing the steam to enter the water reservoir, but preventing liquid water from escaping from the reservoir, back through the conduits.

Preferably, a heat-resistant, lower padded layer is further formed on a lower surface of the central portion and on a rear surface of the rear portion. A port may be provided for releasing collected water from the water reservoir. The port may be formed through the lower padded layer and be in fluid communication with the water reservoir. The port is selectively closeable by a cap or other suitable sealing means.

Additionally, the holder may include means for measuring temperature, such as a thermometer, temperature probe or the like, and a visual temperature indicator, such as a temperature gauge. The means for measuring temperature may measure the temperature of the lower padded layer, the temperature of the iron, the outer temperature of the water reservoir, or the temperature of the water contained within the water reservoir. The visual indicator may be a standard thermometer or the like, or may include a segmented, multi-color indicator with, for example, a blue region representing cold temperatures, and a red region representing hot temperatures.

In use, the clothing iron is received within the holder such that the front face of the clothing iron contacts the rear surface of the front portion, the lower face of the clothing iron contacts the upper padding layer, and the rear face of the clothing iron contacts the front surface of the rear portion. The clothing iron may be held within the holder by a releasable clamp or the like. An opening is formed at the upper end of the front portion, and covers the water fill opening of the clothing iron.

If the iron accidentally falls or is tipped over, the inner padded layer and the outer padded layer provide protection to the environment, and to people who may be nearby, from both the heat of the iron, and its weight. Further, water is prevented from spilling into the environment from the clothing iron by the connection of the water reservoir to the water fill opening of the clothing iron. Spilled water collects within the reservoir and may be released through the port.

Further, the water collected within the reservoir may be used at a future time to fill the clothing iron, thus conserving water. If the user wishes to fill the iron with water, the user may use the water already collected within the water reservoir or may, alternatively, fill the reservoir with water from an external source via the port.

Alternatively, the water reservoir may be replaced by a thermally insulating shell, which is preferably filled with a thermally insulating, padded and steam absorbent material. The opening formed at the upper end of the front portion in this alternative embodiment is replaced with a plug for sealing the water fill opening of the clothing iron. Thus, water is prevented from exiting the water fill opening of the clothing iron, and any steam released by the clothing iron is received and absorbed by the thermally insulating, padded and steam absorbent material filling the thermally insulating shell.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
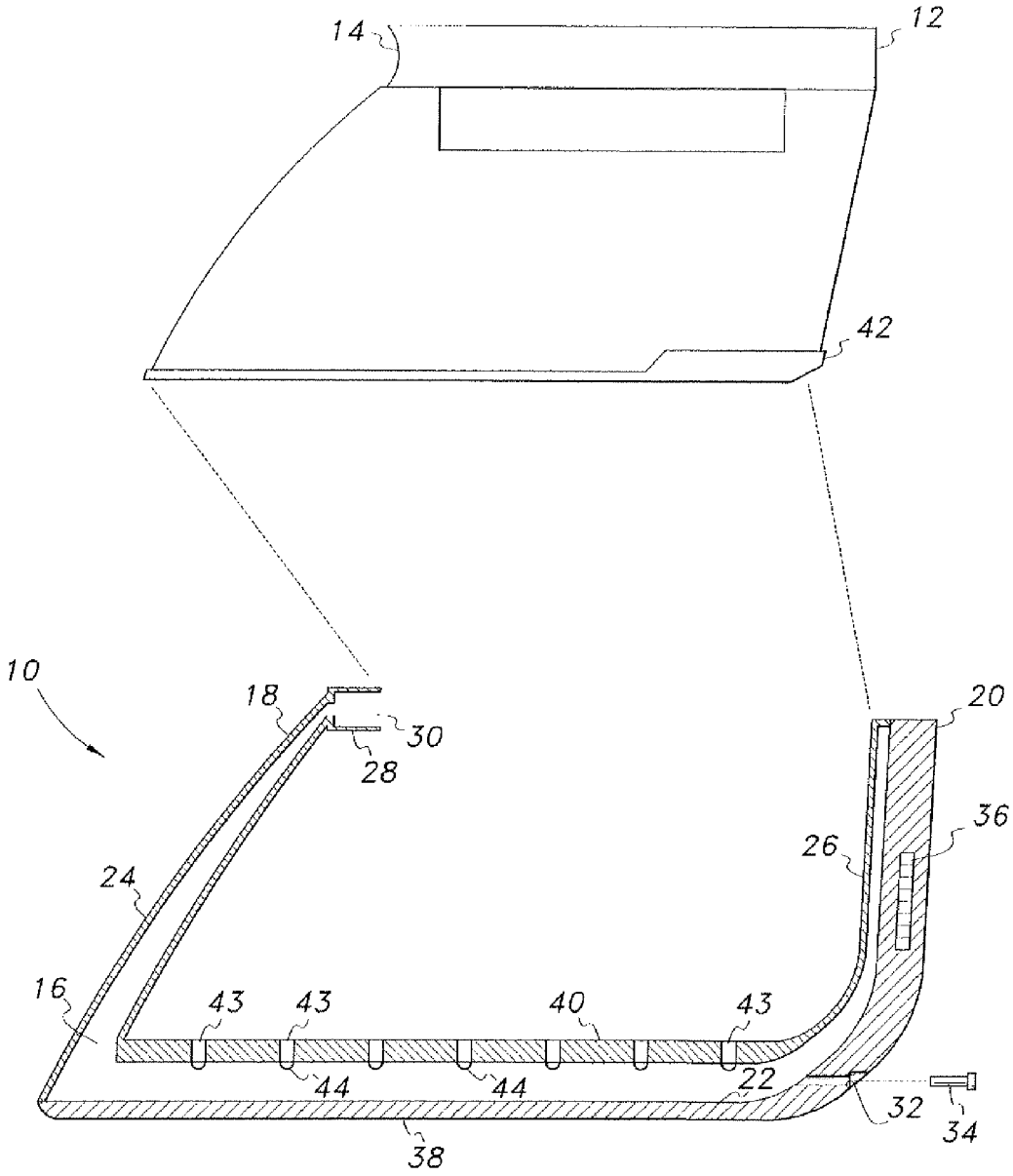
FIG. 1 is an exploded side view in section of a clothing iron holder with water reservoir according to the present invention.
Figure 2:
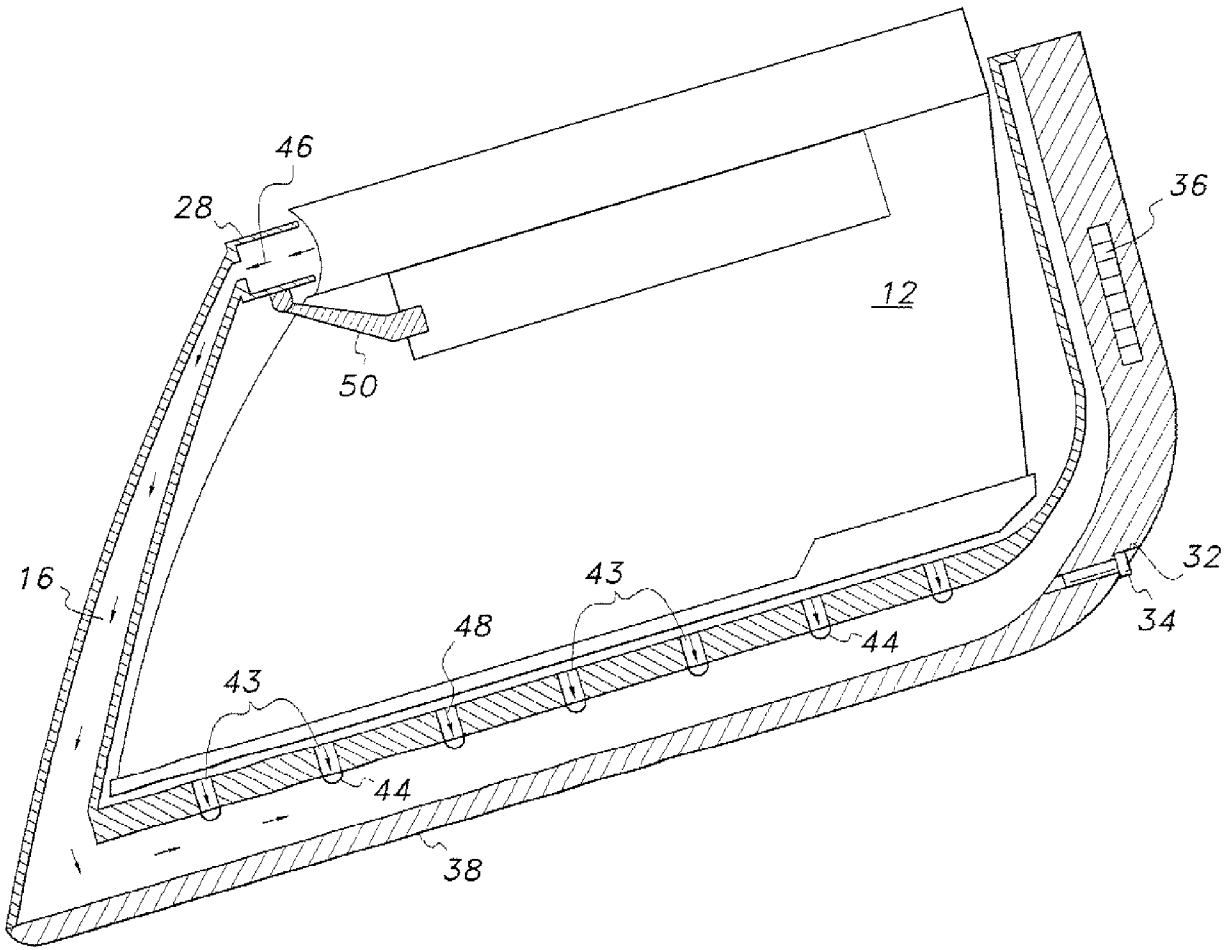
FIG. 2 is a side view in section of the clothing iron holder with water reservoir according to the present invention, illustrating the clothing iron holder holding and retaining a clothing iron therein.

The clothing iron holder with water reservoir 10 is a protective accessory for use with a clothing iron, such as exemplary steam iron 12, shown in FIGS. 1 and 2, or the like. The holder 10 includes a water reservoir 16 having a front portion 18, a central portion 22 and a rear portion 20, and is sized and shaped to receive the clothing iron 12. The water reservoir 16 may be formed from any suitable material, dependent upon the particular needs and desires of the user. Preferably, the water reservoir 16 is formed from a resilient material, allowing for the iron 12 to be easily placed therein, and removed therefrom, while providing secure retention when the iron is positioned within the holder (as shown in FIG. 2). The water reservoir may further be formed from a relatively clear or transparent material, such as Plexiglass®, thus allowing the user to visually determine the water level within reservoir 16.

The front portion 18 has an opening 30 formed therethrough for releasably covering and connecting to a water fill opening 14 of the clothing iron 12, such that water exiting the water fill opening 14 is received within the water reservoir 16 (as shown in FIG. 2). Thus, if the iron 12 accidentally falls or is tipped over, the water will spill into, and be collected within, the water reservoir 16. As shown in FIG. 1, a connector portion 28 is preferably formed at the upper end of front portion 18, with the opening 30 being formed through the connector portion 28. As best shown in FIG. 2, the connector portion 28 is contoured to provide secure and sealed engagement about the water fill opening 14 of clothing iron 12.

The front portion 18 of the water reservoir 16 is in fluid communication with the central portion 22, and the central portion 22 is in fluid communication with the rear portion 20. As shown, the rear portion 20 includes a closed upper end for retaining the water therein. Further, when received within the holder 10, a lower face (the heated contact plate) 42 of the clothing iron 12 is supported by an upper surface of the central portion 22, and the upper surface preferably has a heat-resistant, upper padded layer 40 formed thereon. The upper padded layer 40 may be formed from any suitable material that is heat-resistant and provides padded support for the iron 12, dependent upon the particular needs and desires of the user.

As shown in FIG. 1, the water reservoir 16 is defined by an outer wall 24 and an inner wall 26. When held within the holder 10, preferably a front face of the clothing iron 12 securely contacts the inner wall 26 adjacent the front portion 18, and a rear face of the clothing iron 12 securely contacts the inner wall 26 adjacent the rear portion 20. As shown in FIG. 2, a clamp 50 or other suitable means for releasable sec cement may be provided for retaining the clothing iron 12 within the holder 10. The clamp may be any suitable retaining means for releasably securing the iron 12 within the holder 12.

The heat-resistant, upper padded layer 40 may have a plurality of conduits 43 formed therethrough, allowing steam generated by the clothing iron 12 to escape through the conduits 43 and be collected within the water reservoir 16 (illustrated by directional arrows 48 in FIG. 2), where the steam will condense into liquid water. Each conduit 43 is covered and sealed by a one-way valve seal 44, allowing the steam to enter the water reservoir 16, but preventing liquid water from escaping from the reservoir 16, back through the conduits 43. Any suitable type of valve or seal may be utilized for preventing the backflow of water into the conduits 43, dependent upon the particular needs and desires of the user.

Preferably, a heat-resistant, lower padded layer 38, formed from rubber or any other suitable material, is further formed on the outer surface 24 adjacent the central portion 22, and may extend to cover the outer surface 24 adjacent the rear portion. Further, a port 32 may be provided for releasing collected water from the water reservoir 16. The port 32 may be formed through the lower padded layer 38 and is in fluid communication with the water reservoir 16. The port 32 is selectively closeable by a cap, plug or other suitable sealing means 34.

Additionally, the holder 10 may include means for measuring temperature, such as a thermometer, temperature probe or the like, and a visual temperature indicator, such as a temperature gauge 36. The means for measuring temperature may measure the temperature of the lower padded layer 38, the temperature of the iron 12, the outer temperature of the water reservoir 16, or the temperature of the water contained within the water reservoir 16. The choice of temperature sensing means (such as a thermometer, temperature probe, thermocouple, etc.) is dependent upon the particular needs and desires of the user, and may be mounted within the lower padded layer 38, or at any other suitable location.

The visual indicator 36 may be a standard thermometer or the like, or may include a segmented, multi-color indicator with, for example, a blue region representing cold temperatures, and a red region representing hot temperatures. Any suitable visual indicator or temperature may be utilized, dependent upon the particular needs and desires of the user.

Figure 4:
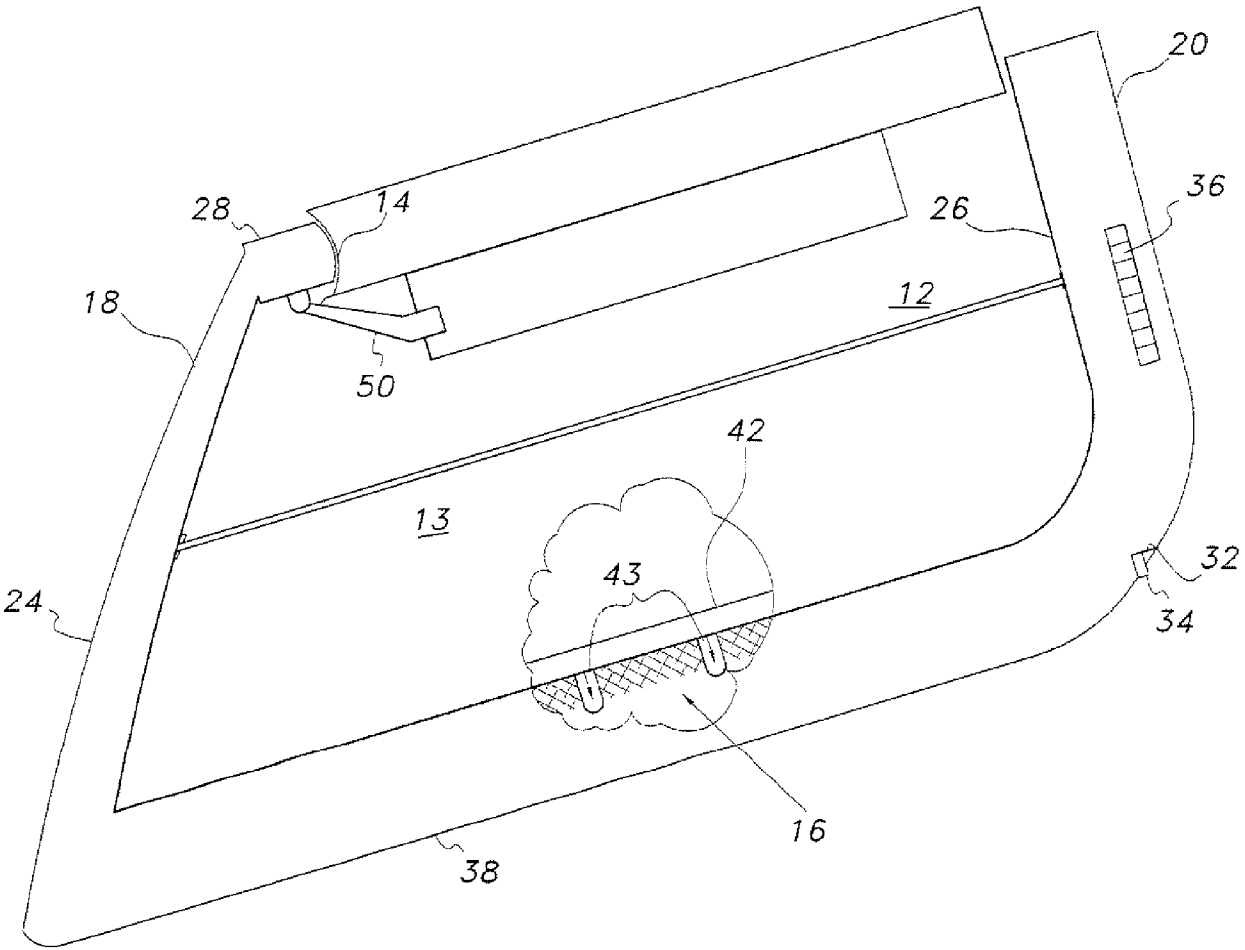
FIG. 4 is a side view of the clothing iron holder with water reservoir of FIG. 2.

In use, the clothing iron 12 is received within the holder 10 such that the front face of the clothing iron 12 contacts the rear surface of the front portion 18, the contact plate of the clothing iron 12 contacts the upper padded layer 40, and the rear face of the clothing iron 12 contacts the front surface of the rear portion 20. The clothing iron 12 may be held within the holder 10 by releasable clamp 50 or through any other suitable means for releasable securement. An opening 30 is formed through connector portion 28, at the upper end of the front portion 18, and covers the water fill opening 14 of the clothing iron 12. In use, as shown in FIG. 4, the holder 10 is wrapped around the clothing iron 12, with sidewalls 13 preferably extending approximately one inch above the heated contact plate 42. It should be understood that the holder 10 may vary in size and/or relative dimensions depending on the particular make and model of the clothing iron 12.

If the iron 12 accidentally falls or is tipped over, the inner padded layer 40 and the outer padded layer 38 provide protection to the environment, and to people who may be nearby, from both the heat of the iron 12, and its weight. Further, water is prevented from spilling into the environment from the clothing iron 12 by the connection of the water reservoir 16 to the water fill opening 14 of the clothing iron 12. Spilled water collects within the reservoir 16 (shown by directional arrows 46 in FIG. 2) and may be released through the port 32.

Further, the water collected within the reservoir 16 may be used at a future time to fill the clothing iron 12, thus conserving water. If the user wishes to fill the iron 12 with water, the user may use the water already collected within the water reservoir 16 or may, alternatively, fill the reservoir 16 with water from an external source via the port 32.

Figure 3:
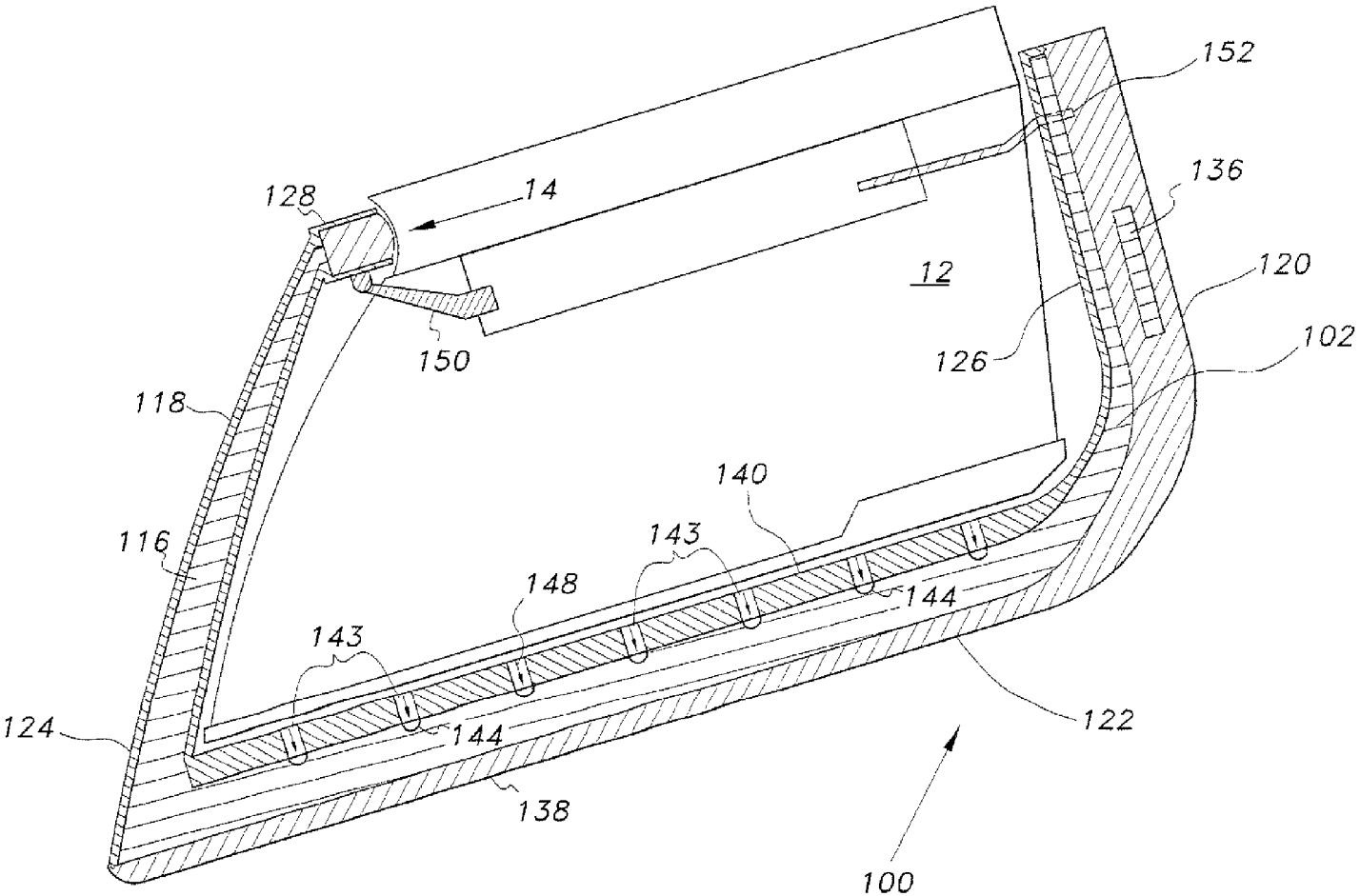
FIG. 3 is a side view in section of an alternative embodiment of a clothing iron holder according to the present invention, illustrating the alternative clothing iron holder holding and retaining a clothing iron therein.

The alternative embodiment of FIG. 3 is similar to holder 10, but the clothing iron holder 100 of FIG. 3 does not include an open reservoir, such as reservoir 16. Rather, the front portion 118 terminates at an upper end thereof with a plug 128 for covering and sealing the water fill opening 14 of the clothing iron 12, such that water is prevented from exiting the water fill opening 14; i.e., open connector portion 28 of the previous embodiment is replaced by plug 128, which prevents water from spilling or otherwise exiting from the water fill opening 14. The plug 128 is contoured to provide secure and sealed engagement about the water fill opening 14 of the clothing iron 12.

Similar to the previous embodiment, the holder 100 includes a front portion 118, a central portion 122, and a rear portion 120. Similar to the holder 10, the front portion 118, the central portion 122 and the rear portion 120 are each hollow, defining a continuous cavity 116 therethrough. However, rather than being open for receiving water, the cavity 116 is filled with a padded, insulating and heat retardant material 102, such as silicone, thermally insulating foam or the like.

When received within the holder 100, a lower face (the heated contact plate) 42 of the clothing iron 12 is supported by an upper surface of the central portion 122, and the upper surface preferably also has a heat-resistant, upper padded layer 140 formed thereon. The upper padded layer 140 may be formed from any suitable material that is heat-resistant and provides padded support for the iron 12. The padded layer 140 may be formed from the same material as padding 102, or may be formed from a dissimilar material.

As shown in FIG. 3, the cavity 116 is defined by an outer wall 124 and an inner wall 126. When held within the holder 100, a front face of the clothing iron 12 preferably securely contacts the inner wall 126 adjacent the front portion 118, and a rear face of the clothing iron 12 securely contacts the inner wall 126 adjacent the rear portion 120. As further shown, a front clamp 150 or other suitable means for releasable securement may be provided for retaining the clothing iron 12 within the holder 100 along the front face thereof. The clamp 150 may be any suitable retaining means for releasably securing the iron 12 within the holder 100. Similarly, a rear clamp 152 is further provided, secured to the rear portion 120, for securing the rear portion of the clothing iron 12 to the rear portion 120 of holder 100. Similar to the front clamp 150, the rear clamp 152 may be any suitable retaining means for releasably securing the iron 12 within the holder 100.

The heat-resistant, upper padded layer 140 may have a plurality of conduits 143 formed therethrough, allowing steam generated by the clothing iron 12 to escape through the conduits 143 and be absorbed by the padded layer 102 (illustrated by directional arrows 148). Each conduit 143 is preferably covered and sealed by a one-way valve seal 144, allowing the steam to enter the padded layer 102, but preventing liquid water or steam from escaping from the cavity 116, back through the conduits 143. It should be understood that the material forming the padded layer 102 is not only heat-retardant and padded, but is also absorbent. Any suitable type of valve or seal may be utilized for preventing the backflow of water into the conduits 143.

Preferably, a heat-resistant, lower padded layer 138, formed from rubber or any other suitable material, is further formed on the outer surface 124 adjacent the central portion 122, and may extend to cover the outer surface 124 adjacent the rear portion. Additionally, the holder 100 may include means for measuring temperature, such as a thermometer, temperature probe or the like, and a visual temperature indicator, such as a temperature gauge 136. The means for measuring temperature may measure the temperature of the lower padded layer 138, the temperature of the iron 12, or the temperature of the padding material 102 filling the cavity 116. The choice of temperature sensing means (such as a thermometer, temperature probe, thermocouple, etc.) may be mounted within the lower padded layer 138, or at any other suitable location.

The visual indicator 136 may be a standard thermometer or the like, or may include a segmented, multi-color indicator with, for example, a blue region representing cold temperatures, and a red region representing hot temperatures. Any suitable visual indicator or temperature may be utilized.

In use, the clothing iron 12 is received within the holder 100 such that the front face of the clothing iron 12 contacts the rear surface of the front portion 118, the contact plate of the clothing iron 12 contacts the upper padded layer 140, and the rear face of the clothing iron 12 contacts the front surface of the rear portion 120. The clothing iron 12 may be held within the holder 100 by releasable clamps 150, 152 or through any other suitable means for releasable securement. The plug 128 covers and seals the water fill opening 14 of the clothing iron 12. Similar to that described above with regard to the embodiment of FIG. 4, in use, the holder 100 is wrapped around the clothing iron 12 with the sidewalls thereof preferably extending approximately one inch above the heated contact plate. It should be understood that the holder 100 may vary in size and/or relative dimensions, depending on the particular make and model of the clothing iron 12.

If the iron 12 accidentally falls or is tipped over, the inner padded layer 140 and the outer padded layer 138 provide protection to the environment, and to people who may be nearby, from both the heat of the iron 12, and its weight. Further, water is prevented from spilling into the environment from the clothing iron 12 by the connection of plug 128 to the water fill opening 14 of the clothing iron 12. When the iron 12 is cooled, the iron 12 may be removed from the holder 100, allowing the inner padded layer 140 and the absorbent material 116, along with padded layer 120, to air dry.

It is to be understood that the present invention is not limited to the embodiments described above, but encompasses any and all embodiments within the scope of the following claims.

I claim:

1. A clothing iron holder, comprising:

a thermally insulating shell having a front portion, a central portion and a rear portion, the front portion defining a plug at an upper end thereof and having a front surface and a rear surface, the plug being adapted for releasably covering and sealing a water fill opening of a clothing iron, the rear portion having a closed upper end and having opposed front and rear surfaces, the central portion having an upper surface and a lower surface, the front, central and rear portions of the thermally insulating shell defining an interior cavity, the interior cavity being filled with a thermally insulating, padded and steam absorbent material, wherein the clothing iron is received by the clothing iron holder such that a front face of the clothing iron contacts the rear surface of the front portion, a rear face of the clothing iron contacts the front surface of the rear portion, and a lower face of the clothing iron is supported by the upper surface of the central portion, the plug formed at the upper end of the front portion releasably covering and sealing the water fill opening of the clothing iron such that water is prevented from exiting the water fill opening.

2. The clothing iron holder as recited in claim 1, further comprising an upper padded layer secured to the upper surface of the central portion.

3. The clothing iron holder as recited in claim 2, wherein at least one conduit is formed through the upper surface of the central portion and the upper padded layer, the at least one conduit being adapted for transferring water vapor from the clothing iron to the thermally insulating, padded and steam absorbent material.

4. The clothing iron holder as recited in claim 3, further comprising at least one one-way valve seal covering and sealing the at least one conduit.

5. The clothing iron holder as recited in claim 1, further comprising:

means for measuring temperature; and a temperature gauge in communication with said means for measuring temperature, the temperature gauge being mounted to the water reservoir for visually displaying a temperature.

6. The clothing iron holder as recited in claim 1, further comprising a lower padded layer formed on the lower surface of the central portion.

7. The clothing iron holder as recited in claim 1, further comprising means for releasably securing the front portion to a front portion of the clothing iron.

8. The clothing iron holder as recited in claim 7, further comprising means for releasably securing the rear portion to a rear portion of the clothing iron.

9. A clothing iron holder, comprising:

a thermally insulating shell having a front portion, a central portion and a rear portion, the front portion defining a plug at an upper end thereof and having a front surface and a rear surface, the plug being adapted for releasably covering and sealing a water fill opening of a clothing iron, the rear portion having a closed upper end and having opposed front and rear surfaces, the central portion having an upper surface and a lower surface, the front, central and rear portions of the thermally insulating shell defining an interior cavity, the interior cavity being filled with a thermally insulating, padded and steam absorbent material;

means for measuring temperature; and a temperature gauge in communication with said means for measuring temperature, the temperature gauge being mounted to the thermally insulating shell, wherein the clothing iron is received by the clothing iron holder such that a front face of the clothing iron contacts the rear surface of the front portion, a rear face of the clothing iron contacts the front surface of the rear portion, and a lower face of the clothing iron is supported by the upper surface of the central portion, the plug formed at the upper end of the front portion releasably covering and sealing the water fill opening of the clothing iron such that water is prevented from exiting the water fill opening.

10. The clothing iron holder as recited in claim 9, further comprising an upper padded layer secured to the upper surface of the central portion.

11. The clothing iron holder as recited in claim 10, wherein at least one conduit is formed through the upper surface of the central portion and the upper padded layer, the at least one conduit being adapted for transferring water vapor from the clothing iron to the thermally insulating, padded and steam absorbent material.

12. The clothing iron holder as recited in claim 11, further comprising at least one one-way valve seal covering and sealing the at least one conduit.

13. The clothing iron holder as recited in claim 12, further comprising a lower padded layer formed on the lower surface of the central portion.

14. The clothing iron holder as recited in claim 13, further comprising means for releasably securing the front portion to a front portion of the clothing iron.

15. The clothing iron holder as recited in claim 14, further comprising means for releasably securing the rear portion to a rear portion of the clothing iron.

16. A clothing iron holder, comprising:

a thermally insulating shell having a front portion, a central portion and a rear portion, the front portion defining a plug at an upper end thereof and having a front surface and a rear surface, the plug being adapted for releasably covering and sealing a water fill opening of a clothing iron, the rear portion having a closed upper end and having opposed front and rear surfaces, the central portion having an upper surface and a lower surface, the front, central and rear portions of the thermally insulating shell defining an interior cavity, the interior cavity being filled with a thermally insulating, padded and steam absorbent material; and means for releasably securing said thermally insulating shell to the clothing iron, wherein the clothing iron is received by the clothing iron holder such that a front face of the clothing iron contacts the rear surface of the front portion, a rear face of the clothing iron contacts the front surface of the rear portion, and a lower face of the clothing iron is supported by the upper surface of the central portion, the plug formed at the upper end of the front portion releasably covering and sealing the water fill opening of the clothing iron such that water is prevented from exiting the water fill opening.

17. The clothing iron holder as recited in claim 16, further comprising an upper padded layer secured to the upper surface of the central portion.

18. The clothing iron holder as recited in claim 17, wherein at least one conduit is formed through the upper surface of the central portion and the upper padded layer, the at least one conduit being adapted for transferring water vapor from the clothing iron to the thermally insulating, padded and steam absorbent material.

19. The clothing iron holder as recited in claim 18, further comprising a lower padded layer formed on the lower surface of the central portion.

20. The clothing iron holder as recited in claim 19, further comprising:

means for measuring temperature; and a temperature gauge in communication with said means for measuring temperature, the temperature gauge being mounted to the water reservoir for visually displaying a temperature.

* * * * *